United States Patent [19]

Densen

[11] 4,243,282

[45] Jan. 6, 1981

[54] KNOCK DOWN CABINET

[75] Inventor: Mark S. Densen, Summit, N.J.

[73] Assignee: Eastern Packaging and Display Co., Bloomfield, N.J.

[21] Appl. No.: 14,257

[22] Filed: Feb. 22, 1979

[51] Int. Cl.[3] ..... A47B 43/02; A47B 61/00

[52] U.S. Cl. ..... 312/259; 312/258

[58] Field of Search ..... 312/108, 111, 140.2, 312/257 R–262

[56] References Cited

U.S. PATENT DOCUMENTS

| | | | |
|---|---|---|---|
| 2,522,561 | 9/1950 | Blechman | 312/259 |
| 3,360,321 | 12/1967 | Novales | 312/257 R |
| 3,437,392 | 4/1969 | Hilfinger | 312/258 |

FOREIGN PATENT DOCUMENTS

| | | | |
|---|---|---|---|
| 1230551 | 9/1960 | France | 312/258 |
| 2388976 | 12/1978 | France | 312/258 |

*Primary Examiner*—Casmir A. Nunberg

*Attorney, Agent, or Firm*—Arthur T. Fattibene

[57] ABSTRACT

A relatively inexpensive knock-down type cabinet for use as a wardrobe or storage cabinet comprising a pair of die cut blanks, each of which can be readily folded to define two like shaped sections arranged to complement one another in the assembled position to define a rectangularly shaped cabinet having an open front access opening which is closed by a sliding door. Suitable fastening means secure the respective folded sections in the assembled position, the arrangement being such that the cabinet can be readily assembled and secured without the need of any hand tools.

9 Claims, 5 Drawing Figures

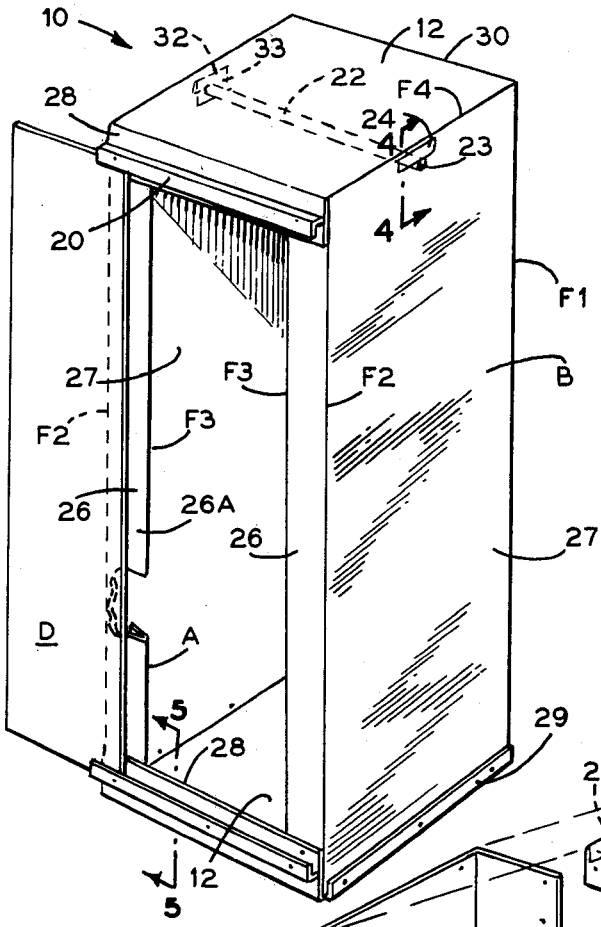
FIG. 3
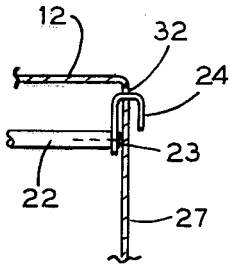
FIG. 4
FIG. 2
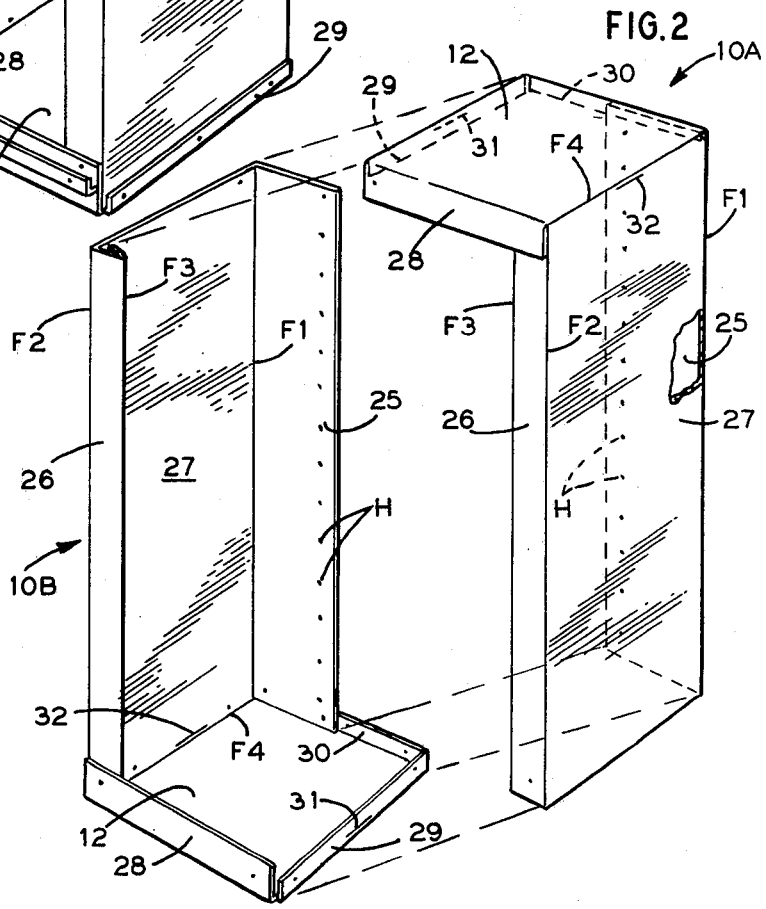
FIG. 5
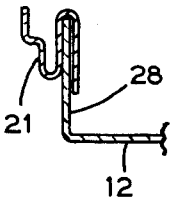

KNOCK DOWN CABINET

PROBLEM AND PRIOR ART

Heretofore various efforts have been made to construct a storage cabinet out of blank sheet material as evidenced by the prior known patented constructions, such as U.S. Pat. Nos.: 1,943,044; 1,947,955; 1,986,279; 2,299,766; 2,323,103; 2,455,739; 2,522,561; 3,279,873; and 3,322,478. Relatively speaking, these known constructions for the most part required a number of differently shaped parts to be assembled one to another. Consequently, the material for which each such part was made required a specifically shaped die formed blank which then required folding to form the proper shape for assembly. Thus, the greater the number of blanks required and the subsequent folding necessitated thereby serve only to increase the cost of manufacture and complicate the assembly of such cabinets. Other efforts included the forming of such cabinets from a single sheet of blank material. However, such blanks are generally complicated in the forming thereof, and further, the cabinet formed thereby generally required a reinforcing member to be located at the stress points of the construction, e.g., as noted in U.S. Pat. No. 2,455,739.

OBJECTS

An object of this invention is to provide a relatively simple and sturdily constructed cabinet which can be readily fabricated of blank sheet material which is predie cut, and which can be readily assembled with a minimum of ease and effort.

Another object is to provide a knock down cabinet which can be made from two like die cut blanks which when folded define two identical half sections, which can be readily assembled to define a complete cabinet body.

Another object is to provide a knock down cabinet which can be readily formed of sheet cardboard material of identical blank shape which can be readily folded and assembled to define a cabinet body.

Another object is to provide a cabinet construction which can be formed of two identical, complementary half sections.

Another object is to provide a cabinet construction which can be readily assembled and secured without the need of any hand tools.

Another object is to provide a readily, knock-down cabinet formed of sheet material which is sturdy in construction and wherein the assembled cabinet is rendered self-supporting and free of any reinforcing frame structure.

Other features and advantages will become readily apparent when considered in view of the drawings and specification in which:

FIG. 2 illustrates an exploded perspective view of a pair of like closet sections prior to assembly.

FIG. 3 is a perspective view of the assembled cabinet construction embodying the present invention.

FIG. 4 is a section view taken on line 4—4 of FIG. 3.

FIG. 5 is a section view taken on line 5—5 of FIG. 3.

BRIEF SUMMARY OF INVENTION

Figure 1:
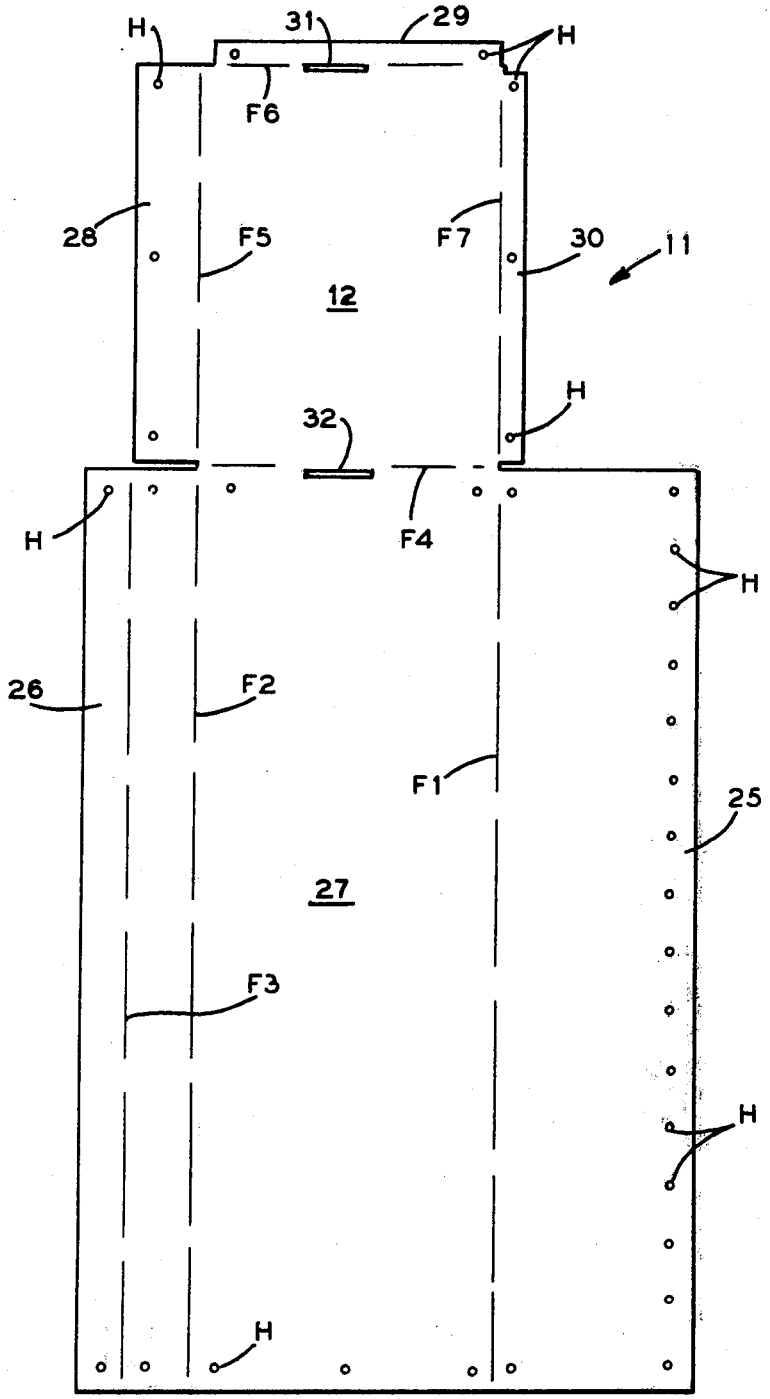
FIG. 1 is a plan view of a die formed blank of sheet material from which a closet section is formed.

The foregoing objects and other features and advantages are attained by a cabinet construction which is readily formed from two sheets of blank sheet material which are of like shape, each blank being prefolded to define identical, complementary sections, and which sections can be readily assembled to define a complete cabinet body. In the assembled position, the cabinet body formed is provided with a front access opening which is closed by a sliding door. The respective sections are secured in the assembled position by screw and nut type fasteners so as to facilitate assembly without the need of any hand tools.

DETAILED DESCRIPTION

Referring to the drawings, the cabinet construction 10 as best seen in FIG. 3 comprises a cabinet body B which is constructed from two sheets of blank material, e.g., cardboard, hardboard or the like, which is die cut to a predetermined shape and thereafter folded to define a complementary half section of the cabinet body B. FIG. 1 illustrates the expanded die cut blank 11 from which the respective cabinet sections 10A and 10B are formed. As noted in FIG. 1, the blank 11 is die cut so as to define a side wall portion 27 to which a back wall flap 25 is hingedly connected along a foldline $F_1$. Connected to the opposed edge of the side wall 27 along foldline $F_2$ is a strip 26 which in the assembled position defines a front marginal edge of the cabinet. As seen, the strip 26 is provided with an intermediate foldline $F_3$ about which the strip 26 can be reversely folded to define a double thickness front edge 26B. Connected to one edge of the side wall portion 27 along foldline $F_4$ is a panel 12 which in the folded position of the blank 11 will define either the top or bottom end wall portion 12 of the assembled cabinet depending upon the orientation of the folded sections 10A or 10B, as will be herein described.

The respective free edge portions of panel or end wall portion 12 have hingedly connected thereto along foldlines $F_5$, $F_6$, and $F_7$, flaps 28, 29, and 30, respectively. Flap 28 in the folded position defines a front flap to which a guide rail 20 is connected for receiving a sliding door D, as will be hereinafter described. Flap 29 defines a side flap and flap 30 defines a back flap. The blank 11 described is provided with preformed holes H, as shown, which when folded are arranged to be aligned with complementary holes formed on a similarly constructed section, so the assembled complementary sections 10A and 10B can be secured with screw and nut type fasteners of the type which can be threaded and tightened by hand.

As best seen in FIG. 2, the blank 11 described can be readily folded to define a half cabinet body section 10A or 10B. This is attained by folding the back portion 25 normal to the side panel 27 along foldline $F_1$ and folding panel 12 normal to both the side panel 27 and back panel 25. Thus, the panel 12 will rest along one side of panels 27 and 25. The strip 26 is then reversely folded along foldlines $F_3$, and thereafter, folded at right angles to side 27 along foldline $F_2$. The flaps 28, 29 and 30 are then folded normal to their respective foldlines $F_5$, $F_6$ and $F_7$. By inserting screw and nut fasteners through the holes formed in flaps 28 and 30, which are in alignment with the holes formed in the adjacent back panel 25 and front edge 26, the folded blank 11 defines a half section as indicated by 10A or 10B.

The cabinet body B as shown in FIG. 3 can thus be readily assembled by two described folded sections 10A and 10B simply by reversing one section relative to the other as indicated in FIG. 2, and securing the respective sections by inserting the fasteners through the holes H, which will automatically align when the two sections 10A and 10B are in proper position.

In the assembled position, as shown in FIG. 3, the cabinet body is formed with a front access opening A, which is defined by the front edges 26, and the upper and lower front flaps 28.

Connected to the upper and lower front flaps 28–28 are a rail members 20 and 21 in which a door closure D is free to slide.

The cabinet may also be provided with a transverse rod hanger 22. Referring to FIG. 1, the support for the rod hanger 22 comprises preformed slots 31 and 32 adjacent foldlines $F_4$ and $F_2$. The respective slots 31 and 32 are arranged to receive a reversely folded metal clip 33 which straddles the slot as shown in FIG. 3. The inner side of the clip 33 has attached thereto means such as a boss or sleeve which received and supports one end of the hanger rod 22. The hanger 22 may also be secured to bracket or clip 33 by a pin projecting from the end of rod 22.

As is probably best noted in FIG. 2, the back panel 25 of the respective sections 10A and 10B is proportioned so that the back panel is slightly greater than one half of the assembled width of the cabinet so as to provide an overlap of the back panels when the holes along the edge thereof are disposed in alignment.

From the foregoing it will be noted that the cabinet construction 10 described is formed of two identical die cut sheets; each similarly folded, so that by reversing two such folded sections, a cabinet body can be formed. Thus, the construction is limited to a single readily formed die cut sheet, to result in substantial savings in manufacturing. The blanks so formed can be readily shipped and stored in the flat position and readily assembled by persons having little, if any mechanical skills.

If desired, the blanks may be laminated or coated with a layer of decorative material to simulate a wood finish or other colorful or desirable decore.

While the present invention has been described with respect to a particular embodiment thereof, variations and modifications may be made without departing from the spirit or scope of the invention.

What is claimed is:

1. An inexpensive cardboard storage cabinet for clothes comprising primarily of two like die-cut pieces, one piece comprising a top, side, about one-half of the back and horizontal front, side and back flaps, the other like piece being reversed forming the bottom, the opposite side, the other half of the back and the other front, side and back flaps, top and bottom track means extending transversely along the front of said cabinet, a door slidably mounted on said track means, matching holes on said back and said flaps, means secured in said aligned matching holes for holding said backs and said flaps together, in which there are opposed thin metal plates bent over the top edges of said cabinet, each of said plates having a hole formed therein, a hanger rod having projecting end pins, said end pins being received in the holes of said opposed plates for supporting said hanger rods therebetween.

2. A knock-down cabinet comprising a pair of identical cabinet body sections, each of said sections being integrally formed of a die cut blank of foldable sheet material, said die cut blanks includes a side panel portion, a half back panel portion hingedly connected about a foldline extending along a longitudinal edge of said side panel portion, a transverse panel hingedly connected to one edge of said side panel portion along a foldline disposed normal to said first mentioned foldline, a front edge portion hingedly connected along a foldline extending along the other longitudinal edge of said side panel portion, and a flap connected to each free edge of said transverse panel, whereby the respective flaps are folded normal to said transverse panel, said blank when folded defining a complementary half section of said cabinet when disposed in opposed and inverted positions relative to one another, and means for detachably securing two said half sections to define said cabinet.

3. A cabinet as defined in claim 2 and including rail means extending between the opposed front edge portions of said assembled sections, and a door slideably mounted on said rail means.

4. A cabinet as defined in claim 3 and including a hanger means extended between the side panels of said cabinet in the assembled position.

5. An inexpensive cardboard storage cabinet comprising a cabinet body formed of a pair of identical preformed blanks of readily foldable cardboard sheet material, each of said identical blanks comprising a side wall portion, a back wall flap integrally connected along a foldline extending along one edge of said side wall portions, a front marginal flap integrally connected along a foldline along an opposite edge of said side wall portion, and an end panel integrally connected along a foldline extending along a transverse edge of said side wall portion, each of said blanks in the folded position thereof defining complementary identical half sections of said cabinet body, whereby each half section when oppositely disposed and inverted relative to one another define said cabinet body having an open front and means for securing said oppositely disposed and inverted sections to one another for maintaining said sections in the erected position.

6. The storage cabinet as in claim 5 in which the outer face of said cardboard blanks are finished with a paper or plastic sheeting.

7. An inexpensive cardboard storage cabinet as defined in claim 5 wherein said front marginal flaps includes an intermediate foldline about which said marginal flaps is reversely folded.

8. An inexpensive storage cabinet as defined in claim 5 and including a back flap, side flap and front flap integrally connected to a corresponding free edge of said end panel, each of said back flap, side flap and front flap being hingedly connected about a foldline defining the free edges of said end panel.

9. An inexpensive storage cabinet as defined in claim 8 and including a upper and lower transversely extending rail means connected to the front flaps of the respective opposed end panels in the assembled position of said complementary half sections, and a unitary door slidably mounted between said rail means to define a sliding closure for said open front of said cabinet body.

* * * * *